US006711769B1

(12) United States Patent
Jane-Prats

(10) Patent No.: US 6,711,769 B1
(45) Date of Patent: Mar. 30, 2004

(54) PILLOW WITH RETRACTABLE UMBRELLA

(76) Inventor: Marielena Jane-Prats, 2301 Alhambra Cir., Coral Gables, FL (US) 33134

( * ) Notice: Subject to any disclaimer, the term of this patent is extended or adjusted under 35 U.S.C. 154(b) by 0 days.

(21) Appl. No.: 10/378,324

(22) Filed: Mar. 4, 2003

(51) Int. Cl.[7] ..... A47C 20/02
(52) U.S. Cl. ..... 5/639; 5/636; 5/656; 135/16
(58) Field of Search ..... 5/656, 639, 636; 135/16, 15.1, 20.1, 117

(56) References Cited

U.S. PATENT DOCUMENTS 2,561,931 A * 7/1951 Kleiser, Jr. ..... 5/644
2,932,833 A * 4/1960 Wambach ..... 5/656
3,007,735 A * 11/1961 Cohn ..... 297/184.17
4,063,318 A * 12/1977 Nicholson ..... 5/656
4,100,633 A * 7/1978 Pintos ..... 5/418
4,425,675 A * 1/1984 Victor ..... 5/636
4,641,883 A * 2/1987 Kato ..... 297/184.15
5,515,564 A * 5/1996 Lyons ..... 5/639
5,551,110 A * 9/1996 Armstrong et al. ..... 5/656
6,061,850 A * 5/2000 Roper, III ..... 5/418
6,405,742 B1 * 6/2002 Driscoll ..... 135/96

* cited by examiner

*Primary Examiner*—Teri Pham Luu
(74) *Attorney, Agent, or Firm*—J. Sanchelima; A. Bordas

(57) ABSTRACT

A pillow with a retractable umbrella, comprising a pillow assembly with first and second ends. The first and second ends have a channel extending therebetween. Fixedly secured onto the first end of the pillow assembly is a supporting assembly with third and fourth ends. The supporting assembly has a cavity between the third and fourth ends to store items within, and has a removable end-cap to access the cavity. Extending from the supporting assembly is an umbrella assembly. The umbrella assembly lying within the channel in a stored position. The instant invention having rotating and swivel means for positioning the umbrella assembly while in an erect position. The invention may be stored in a case for easy carrying and in an open position, allows a user to lay his/her head on the pillow while covering their face from sunlight.

6 Claims, 4 Drawing Sheets

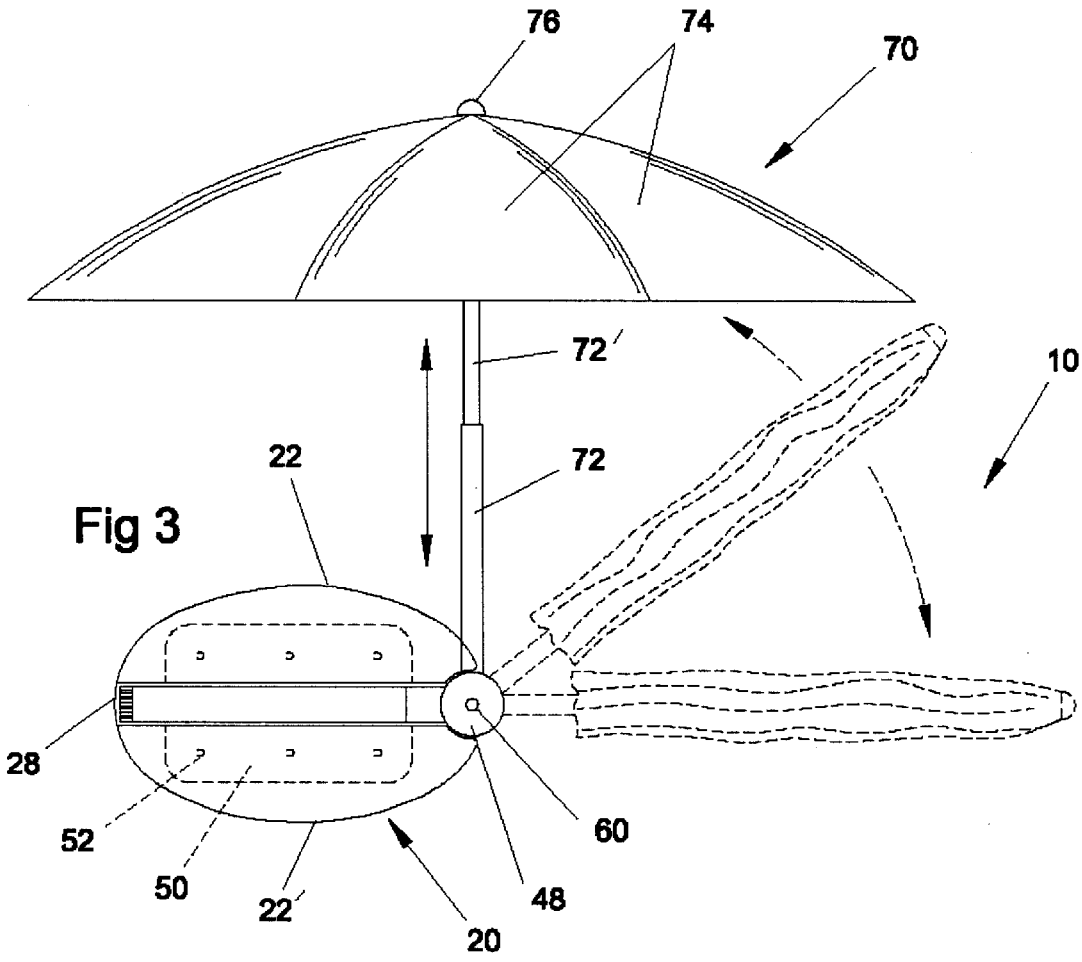
Fig 3
Fig 3A
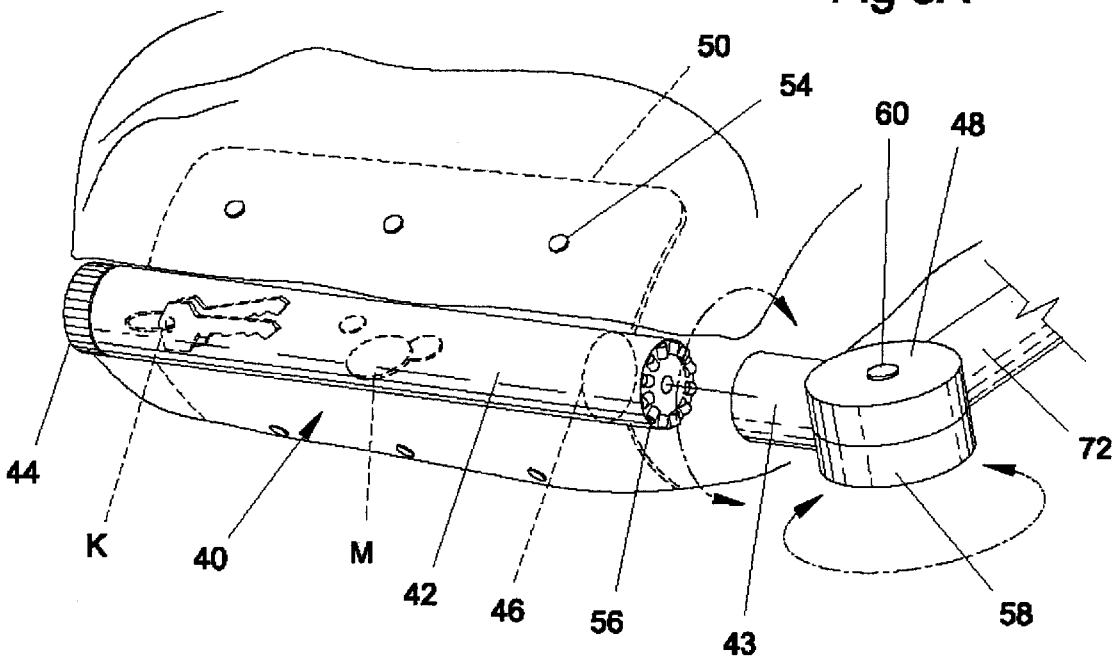

PILLOW WITH RETRACTABLE UMBRELLA

II. BACKGROUND OF THE INVENTION

1. Field of the Invention.

The present invention relates to sunning accessories, and more particularly, to pillows with retractable umbrellas.

2. Description of the Related Art.

Many designs for sunning accessories, such as pillows and neck supports, have been designed in the past. None of them, however, comprise a pillow assembly having a supporting assembly and a retractable umbrella assembly that is easily transportable and allows a user to support his/her head while covering their face from sunlight.

There are no sunning accessories to the best of applicant's knowledge that include a pillow with a retractable umbrella, comprising a pillow assembly having a channel, wherein the retractable umbrella lays within the channel in the stored position, and has rotating and swivel means for umbrella positioning.

III. SUMMARY OF THE INVENTION

A pillow with a retractable umbrella, comprising a pillow assembly having first and second ends. A supporting assembly has third and fourth ends and is fixedly secured onto the first end. The supporting assembly further has rotating means adjacent to the third end. Swivel means are mounted to the third end of the supporting assembly and an umbrella assembly is secured to the swivel means. The rotating means and the swivel means are used to position the umbrella assembly, allowing a user to lay his/her head on the pillow assembly and in shade from sunlight.

The pillow assembly has a channel extending between the first and second ends for stowing the umbrella assembly.

The supporting assembly has a cavity for storage of items. The cavity extends from the fourth end to the rotating means and the fourth end has a removable end-cap to access the cavity.

In the preferred embodiment, the umbrella assembly has telescopic means to extend the umbrella assembly to a predetermined height.

It is therefore one of the main objects of the present invention to provide a pillow with a retractable umbrella for a user to rest his/her head.

It is another object of this invention to provide a pillow with a retractable umbrella that may be positioned to cover a user from sunlight.

It is another object of this invention to provide a pillow with a retractable umbrella that may store items within.

It is still another object of the present invention to provide a pillow with a retractable umbrella that is easily transportable.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 3 illustrates a side view of the instant invention with the umbrella assembly in the open position.

FIG. 3A illustrates an isometric view of the supporting assembly and the rotating and swivel means of the instant invention.

V. DETAILED DESCRIPTION OF THE PREFERRED EMBODIMENT

Figure 1:
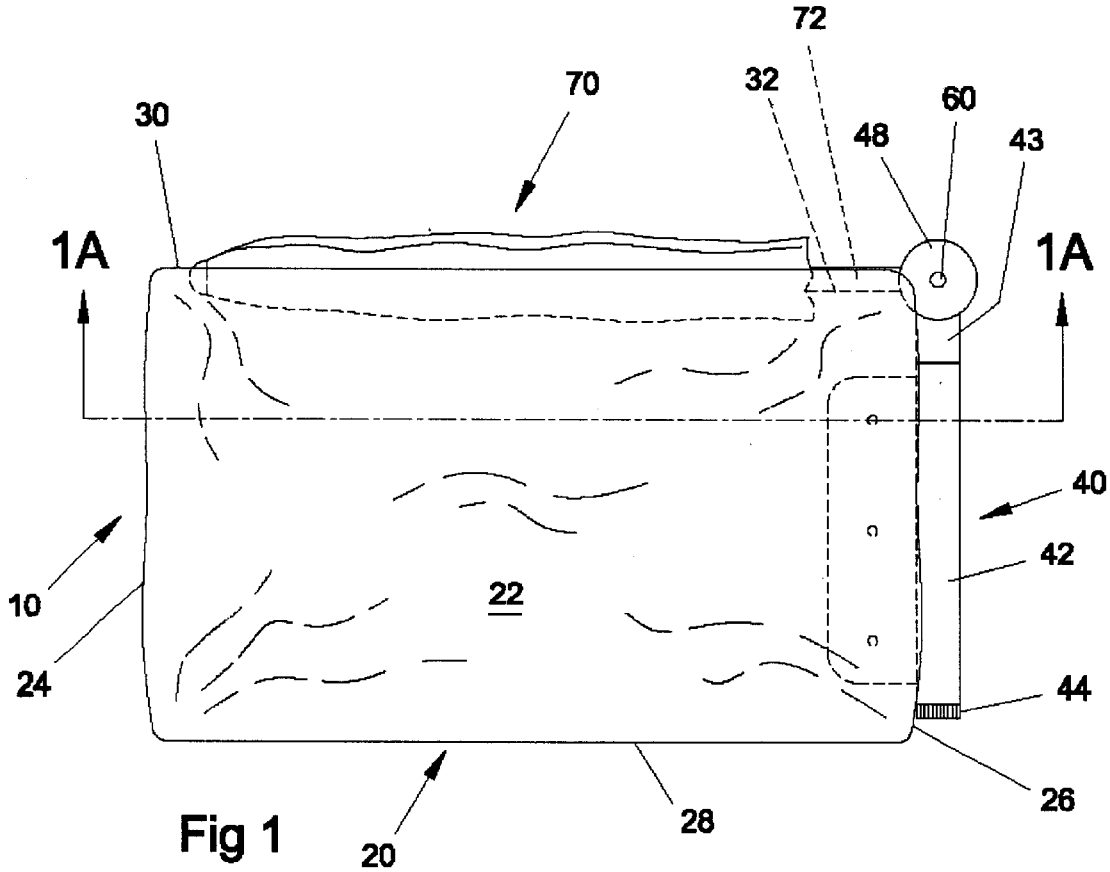
FIG. 1 represents a front isometric view of the instant invention in the stored position.

Referring now to the drawings, where the present invention is generally referred to with numeral 10, it can be observed that it basically includes pillow assembly 20, supporting assembly 40, and umbrella assembly 70.

Figure 1A:
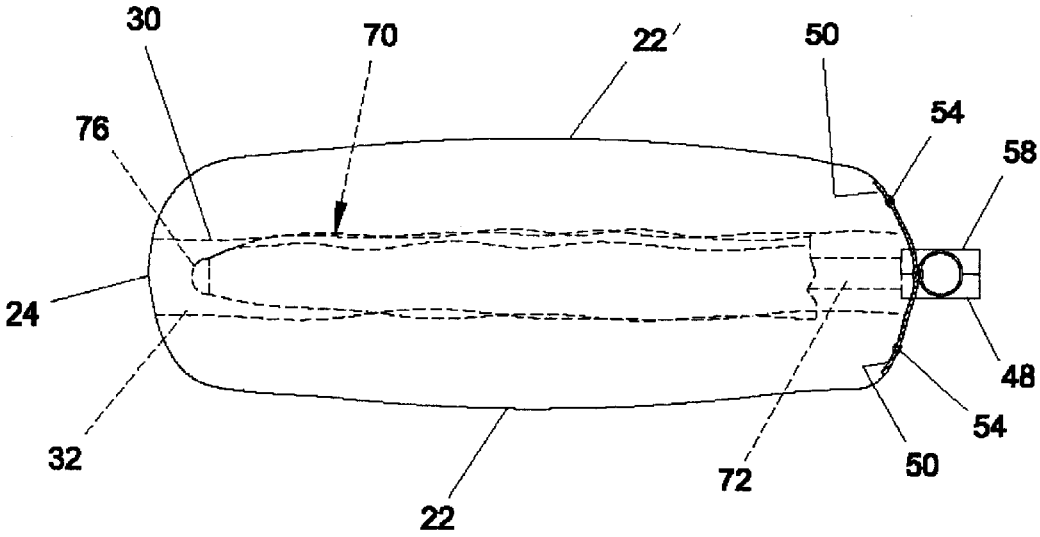
FIG. 1A is a top isometric view of the instant invention taken from the line 1A—1A as seen in FIG. 1.

As seen in FIGS. 1 and 1A, pillow assembly 20 comprises walls 22 and 22' having mutual ends 24 and 26, which are approximately perpendicular to mutual ends 28 and 30.

Fixedly secured onto end 26 is supporting assembly 40. Supporting assembly 40 has elongated tube 42 extending nearly the length of end 26. Extending from tube 42 is shaft 43, which terminates as disk 48. Biasing disks 48 and 58 to one another is pin 60. Extending from disk 58 is shaft 72. Shaft 72 is telescopically connected to shaft 72', seen in FIG. 3, of umbrella assembly 70.

Figure 4:
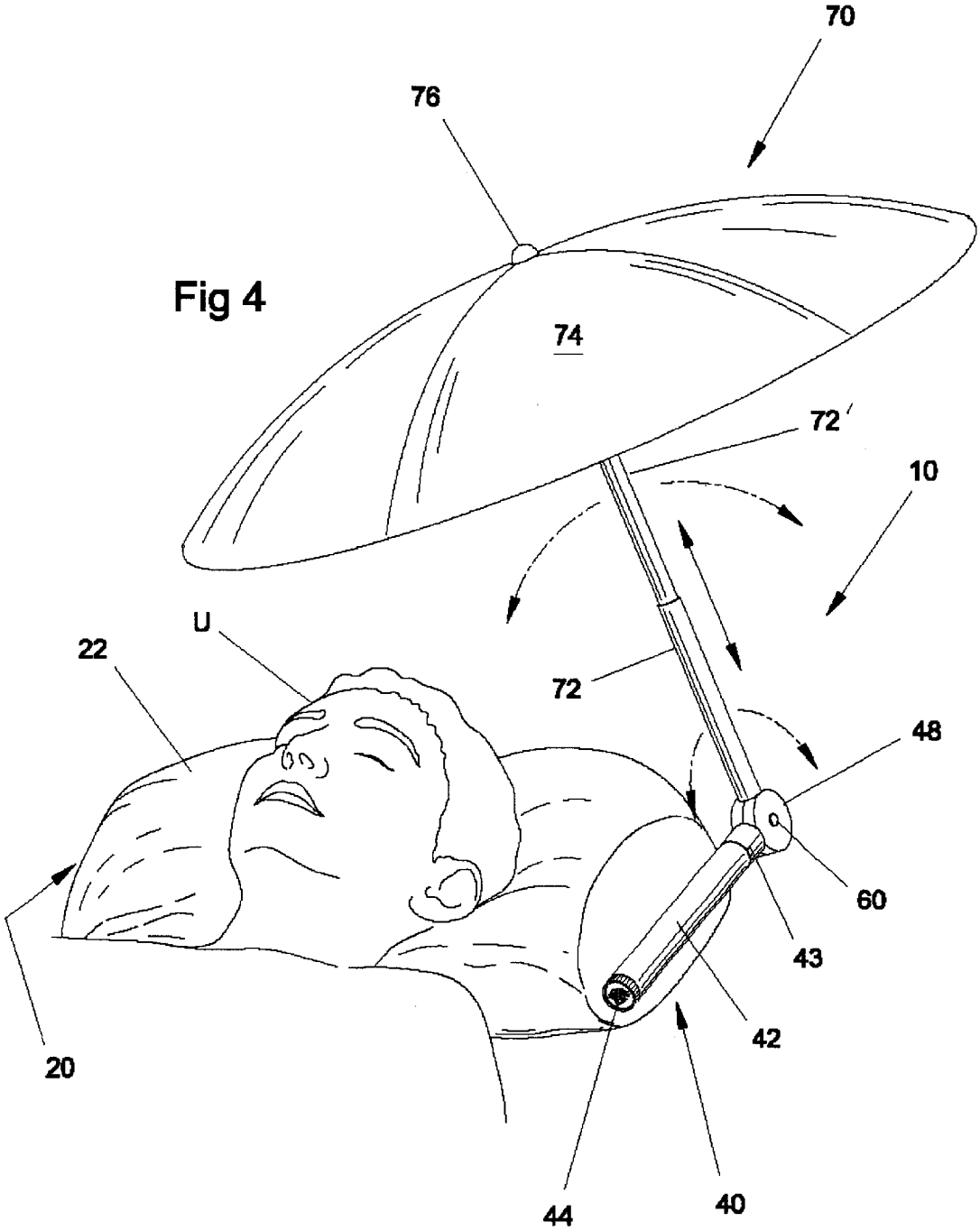
FIG. 4 is a perspective view of the instant invention in the open position with the umbrella assembly partially covering a user.

As better seen in FIG. 1A, end 30 of pillow assembly 20 has elongated channel 32, which extends from end 24 to end 26. In the stored position, as illustrated, umbrella assembly 70 lays within channel 32. In addition, as best illustrated in the present figure, supporting assembly 40 has plates 50 that extend into pillow assembly 20 and are secured onto the interior surface of walls 22 and 22'. Through holes 52, seen in FIG. 2, rivets 54 or similar means of attachment, including but not limited to screws, and nuts and bolts, or adhesives may secure plates 50 thereon. Plates 50 cover a sufficient area over the interior surface of walls 22 and 22' to keep supporting assembly 40 secure, especially when umbrella assembly 70 is in the open position, as seen in FIG. 4.

Figure 2:
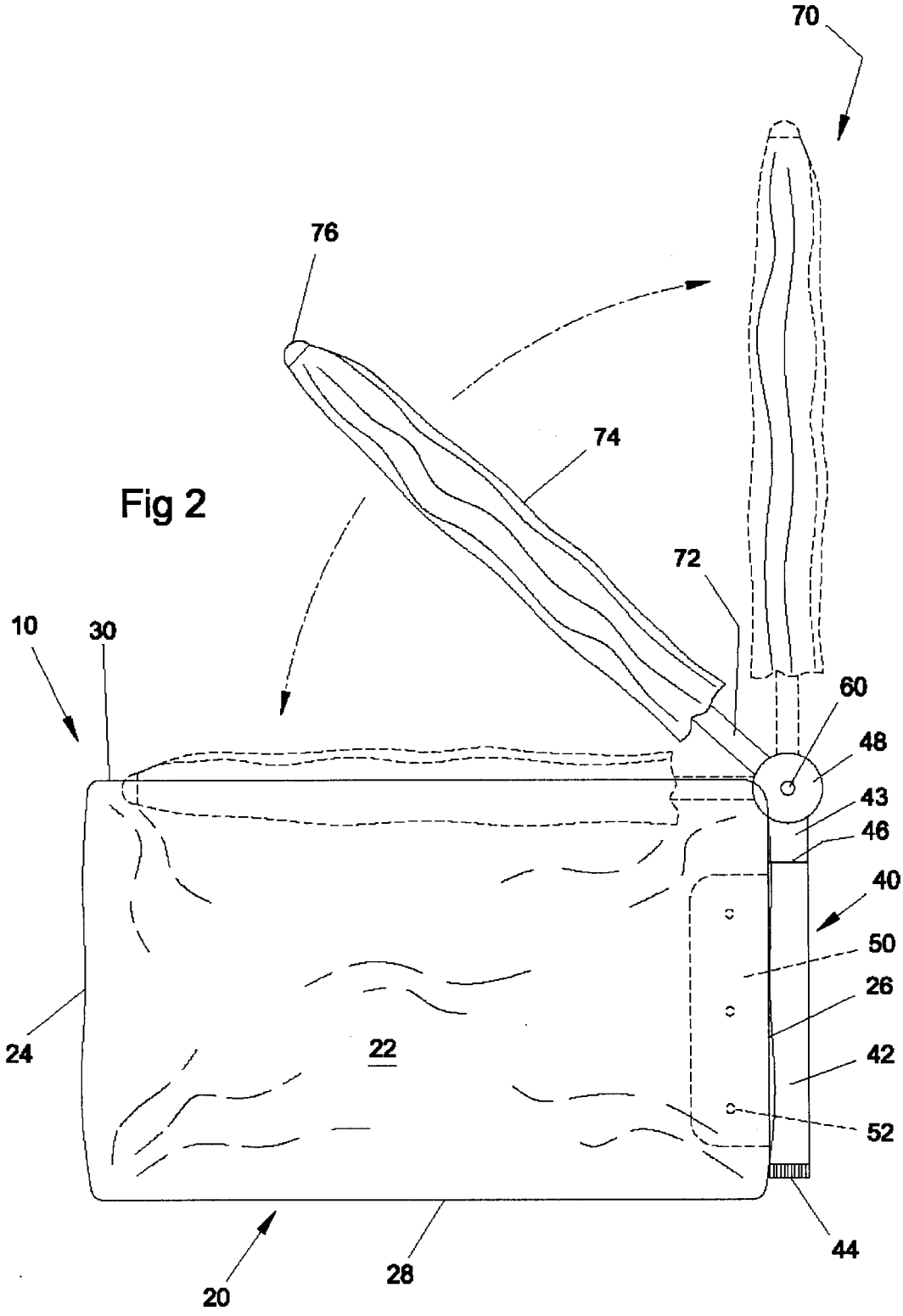
FIG. 2 shows a front isometric view of the instant invention illustrating the swivel means of the instant invention.

As seen in FIG. 2, supporting assembly 40 is secured onto end 26. Supporting assembly 40 comprises elongated tube 42, which is hollow. At one end of tube 42 is end-cap 44. In the preferred embodiment, end-cap 44 is a screw-on type cap having threading with matching characteristics to an end portion of tube 42. Opposite end-cap 44 is interior wall 46.

Umbrella assembly 70 comprises shaft 72, and panels 74 that terminate at bullet 76. As depicted in the illustration, umbrella assembly 70 may swivel from a stored position, when laying within channel 32, to an erect position, wherein shaft 72, and more specifically disk 58, seen in FIG. 3A, is rotatably mounted upon pin 60.

As seen in FIG. 3, umbrella assembly 70 further comprises shaft 72', which is telescopically connected to shaft 72. Shaft 72 has a locking mechanism, not seen, that cooperates with shaft 72' to lock at a predetermined position, when shaft 72' is extended from shaft 72. As depicted in the illustration, umbrella assembly 70 may swivel from an erect position to an open position, wherein shaft 72, and more specifically disk 58, seen in FIG. 3A, is rotatably mounted upon pin 60.

As seen in FIG. 3A, tube 42 of supporting assembly 40 may be utilized to store items such as keys K, money M, or other items fitting within. End-cap 44 provides access to store or remove the items, and the items remain within tube 42 between end-cap 44 and interior wall 46.

At a predetermined distance from disk 48, shaft 43 has rotating assembly 56. Rotating assembly 56 may be a ratchet-type assembly, allowing shaft 43 to snap, click, or otherwise position into an adjustable locking position with relation to supporting assembly 40, thereby providing a rotating means for umbrella assembly 70. In addition, as best seen in this illustration, rivets 54 secure plates 50.

As seen in FIG. 4, the instant invention allows user U to lay his head on pillow assembly 20 while covering his face from sunlight. In addition, the invention may be stored in a drawstring-type case for easy carrying.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pillow with a retractable umbrella, comprising:

A) a pillow assembly having first and second ends;

B) a supporting assembly having third and fourth ends, said supporting assembly fixedly secured onto said first end and having rotating means adjacent to said third end;

C) swivel means mounted to said third end of said supporting assembly; and

D) an umbrella assembly secured to said swivel means, said rotating means and said swivel means to position said umbrella assembly allowing a user to lay his/her head on said pillow assembly and in shade from sunlight, said pillow assembly further having a channel extending between said first and second ends for stowing said umbrella assembly—was inserted after "sunlight."

2. The pillow with a retractable umbrella set forth in claim 1, further characterized in that said supporting assembly has a cavity for storage of items.

3. The pillow with a retractable umbrella set forth in claim 2, further characterized in that said cavity extends from said fourth end to said rotating means, said fourth end has a removable end-cap to access said cavity.

4. The pillow with a retractable umbrella set forth in claim 3, further characterized in that said umbrella assembly has telescopic means to extend said umbrella assembly to a predetermined height.

5. A pillow with a retractable umbrella, comprising:

A) a pillow assembly having first and second ends, said pillow assembly has a channel extending between said first and second ends;

B) a supporting assembly having third and fourth ends, said supporting assembly fixedly secured onto said first end and having rotating means adjacent to said third end, said supporting assembly has a cavity for storage of items, said cavity extends from said fourth end to said rotating means, said fourth end has a removable end-cap to access said cavity;

C) swivel means mounted to said third end of said supporting assembly; and

D) an umbrella assembly secured to said swivel means, said rotating means and said swivel means to position said umbrella assembly allowing a user to lay his/her head on said pillow assembly and in shade from sunlight.

6. The pillow with a retractable umbrella set forth in claim 5, further characterized in that said umbrella assembly has telescopic means to extend said umbrella assembly to a predetermined height.

* * * * *